US006196401B1

(12) United States Patent
Brady et al.

(10) Patent No.: US 6,196,401 B1
(45) Date of Patent: Mar. 6, 2001

(54) SHELVING SYSTEM

(75) Inventors: Timothy D. Brady, Ventura, CA (US); Michael P. Kelly, Oreland, PA (US); Brian F. Russell, Georgetown; Eric S. McIntosh, Berea, both of KY (US)

(73) Assignee: Western Pacific Storage Systems, Inc., Georgetown, KY (US)

( * ) Notice: Subject to any disclaimer, the term of this patent is extended or adjusted under 35 U.S.C. 154(b) by 0 days.

(21) Appl. No.: 08/797,523

(22) Filed: Feb. 7, 1997

(51) Int. Cl.[7] ..... A47B 43/00

(52) U.S. Cl. ..... 211/186; 248/222.51; 248/243

(58) Field of Search ..... 108/151.1, 56.1, 108/153; 211/186, 187, 190, 151; 248/222.51, 243

(56) References Cited

U.S. PATENT DOCUMENTS

| | | | | |
|---|---|---|---|---|
| 3,392,689 | * | 7/1968 | Ferdinand et al. | 108/153 X |
| 3,399,784 | * | 9/1968 | Buchbinder et al. | 211/151 |
| 3,510,010 | | 5/1970 | Gasner . | |
| 3,601,432 | * | 8/1971 | Fenwick et al. | 211/190 X |
| 3,858,988 | * | 1/1975 | Cohen | 403/18 |
| 3,881,829 | | 5/1975 | James . | |
| 3,900,112 | | 8/1975 | Azzi et al. . | |
| 4,270,661 | | 6/1981 | Rosenband . | |
| 4,317,523 | * | 3/1982 | Konstant et al. | 211/187 |
| 4,453,641 | * | 6/1984 | Rasmussen et al. | 211/151 |
| 4,765,493 | | 8/1988 | Kinney . | |
| 4,796,541 | * | 1/1989 | Hastrick | 211/190 X |
| 5,115,920 | | 5/1992 | Tipton et al. . | |
| 5,160,051 | | 11/1992 | Bastos . | |
| 5,199,585 | * | 4/1993 | Schafer | 211/187 |
| 5,259,518 | | 11/1993 | Sorenson et al. . | |
| 5,279,430 | | 1/1994 | Benton . | |
| 5,295,591 | | 3/1994 | Slater . | |
| 5,433,327 | * | 7/1995 | Benvenuti et al. | 211/187 X |

* cited by examiner

*Primary Examiner*—Peter M. Cuomo
*Assistant Examiner*—Stephen Vu
(74) *Attorney, Agent, or Firm*—King and Schickli, PLLC

(57) ABSTRACT

A shelving system includes a shelf and support frame and a novel structure for interconnecting the rails that form the shelf. Specifically, a first shelf rail includes a downwardly depending tongue and an outwardly projecting tab. A second shelf rail includes a side wall and a shelf supporting shoulder. A first slot is provided in a shoulder for receiving the tongue and a second slot is provided in the sidewall for receiving the tab. The tab and tongue are provided in substantially perpendicular planes and when connected the bottom wall of the first rail rests upon the shoulder of the second rail. A crosstie further secures the structure.

7 Claims, 4 Drawing Sheets

10
12
14
16
18
20
22
24
26
28
30
32
36
60

38
40
42
44
46
48
50
52

SHELVING SYSTEM

TECHNICAL FIELD

The present invention relates generally to the field of display and merchandizing shelving or racks and, more particularly, to a shelving system incorporating a novel structure for connecting shelf rails together without fasteners.

BACKGROUND OF THE INVENTION

Gravity flow rack or order picking shelving systems in which merchandise cartons are placed at the rear of downwardly inclined shelves for sliding movement of the cartons toward the front of the shelves are well known in the art. The downwardly inclined shelves of such gravity flow rack systems generally comprise rectangular frames having roller track members and guide track members extending between front and rear shelf frame rails. A particularly commercially successful gravity flow rack system of the type being described is disclosed in, for example, U.S. Pat. No. 4,394,910 to Miller.

To date, many different structural connections have been developed for securing together the side and end rails for a shelf utilized in this type of shelving system. For example, U.S. Pat. No. 5,115,920 to Tipton et al. discloses in FIGS. 5, 14 and 15 a fastenerless structure for interconnecting the end and side rails of a shelf. The side rail includes a first longitudinal slot and a second, cooperating u-shaped slot that defines a resilient flap including an inwardly projecting leg. The end rail includes a hook that is received in the longitudinal slot. The connection of the end and side rails is made by inserting the hook into the longitudinal slot and then shifting the end rail downward relative to the side rail until the inwardly projecting leg of the resilient flap engages the upper surface of the bottom wall of the end rail.

While providing for positive engagement, this structure is relatively expensive to manufacture. It should also be appreciated that the inwardly projecting leg is often bent outwardly during assembly and, when this occurs it no longer provides the desired locking function. Further, when the desired locking function is provided significant difficulty is encountered when seeking to disengage the side and end rails and reconfigure the shelving system. In fact, the inwardly projecting leg is often damaged during disassembly thereby defeating the entire locking function, possibly even necessitating the purchase of a replacement siderail.

Of course, other possible joint structures for connecting the side and end rails of a shelf are also known. Examples of these include, for example, the structures disclosed in U.S. Pat. No. 3,510,010 to Gasner; U.S. Pat. No. 3,858,988 to Cohen and U.S. Pat. No. 3,881,829 to James. While each of these connecting structures provides the convenience of a fastenerless connection, they are all relatively expensive to produce, relatively easily damaged during installation and/or disassembly for subsequent reconfiguration or fail to provide the necessary security of connection for use in a shelving system of the type described.

SUMMARY OF THE INVENTION

Accordingly, it is a primary object of the present invention to provide a shelving system incorporating an improved structural connection for securing shelf siderails and end rails together overcoming the above described limitations and disadvantages of the prior art.

Yet another object of the present invention is to provide a shelving system wherein the side and end rails of the shelf are connected together by a tongue and tab on a first shelf rail that are received in a cooperating pair of slots on a second shelf rail. The tongue, tab and slots are all directionally oriented so as to provide a unique geometry that furnishes ease of reliable and secure connection.

Still another object of the present invention is to provide a shelving system with a connecting structure of high strength and durability which can be connected with little risk of damage to the connecting structure and in fact, may even be quickly disassembled and reassembled without tools while still providing the same reliable interconnection between the component parts.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a shelving system is provided including a shelf and support frame that incorporates an improved fastenerless connecting structure for interconnecting the side and end rails that form each shelf. More specifically, a first shelf rail includes a downwardly depending tongue and an outwardly projecting tab. A second shelf rail that is interconnected to the first shelf rail includes a sidewall, a shelf supporting shoulder, a first slot in the shelf supporting shoulder for receiving the tongue carried on the first shelf rail and a second slot in the sidewall for receiving the tab carried on the first shelf rail.

More specifically describing the invention, the tongue and tab are provided on an end of the first rail. Further, the tongue depends in a first plane and the tab projects in a second plane substantially perpendicular to the first plane. Additionally, the first slot is oriented in the first plane and the second slot is oriented in the second plane. When constructed, the first plane extends substantially horizontally and the second plane extends substantially vertically.

Preferably, the tab is in the form of a hook and when interconnected, the shoulder of the second rail engages the bottom wall of the first rail so as to provide additional stability and rigidity to the connection between the rails. Advantageously, by means of the connecting structure described, the first and second shelf rails may be easily interconnected. This is done by simply inserting the depending tongue into the first slot on the shoulder of the second rail and then pivoting the first rail about the tongue in order to bring the hook into engagement into the second slot. Since the tongue and tab is constructed from the same rigid material as the remainder of the first rail, the interconnection can be made with essentially no risk of damage to the connection structure. Thus, reliable connection is virtually always assured. This is true even if it ever becomes necessary to disassemble the shelving system so that it may be subsequently reconfigured as desire.

In accordance with yet another aspect of this invention, the shelving system includes a pair of first shelf rails and a pair of second shelf-rails interconnected together so as to form a rectangular framework. Further, each of the shelf supporting shoulders includes a pair of registration slots. A crosstie is then provided to interconnect the second shelf rails intermediate the first shelf rails.

More specifically, the crosstie includes a pair of substantially L-shaped projecting lugs at each end. The two lugs of each pair include distal ends that project in opposing directions. Thus, the crosstie is connected to the pair of second shelf rails by simply inserting or dropping the pair of lugs at each end into the pair of registration slots in the shoulder of the adjacent second rail. Upon connection, the orientation of the lugs and their engagement with the shoulders prevent any separation or spreading of the pair of second rails thereby rigidifying the framework and further preventing disengagement of the first and second shelf rails at the corners.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.d to meet the users needs.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figures 1, 3A, 3B:
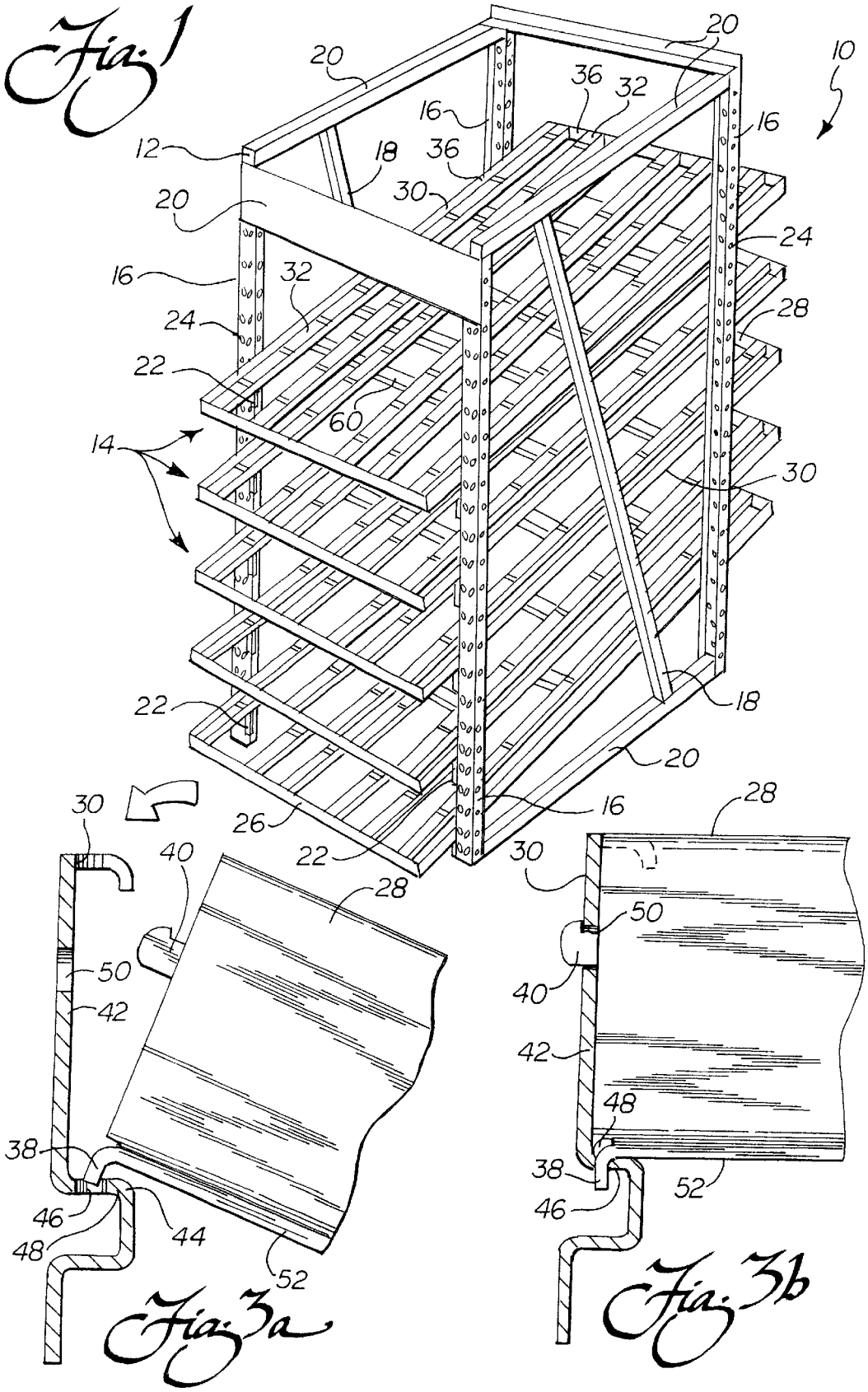
FIG. 1 is a perspective view of a gravity flow rack shelving system generally showing the shelf and support frame.
FIG. 3*a* is a detailed, partially sectional and broken away view showing the initial step in the interconnection of the first and second rails.
FIG. 3*b* is a view similar to FIG. 3*a* but showing the completed connection of the first and second rails.

Reference is now made to FIG. 1 showing a gravity flow rack shelving system 10 which includes a frame 12 for supporting a series of shelves generally designated by reference numeral 14. The frame 12 includes four spaced vertical or upright posts 16 interconnected in a manner well known in the art by means of a series of diagonal struts 18 and cross beams 20. The shelves 14 are supported at spaced vertical locations by means of height adjustable hanger brackets 22 of a type well known in the art. An example of one such hanger bracket design is particularly described in this assignee's co-pending U.S. patent application Ser. No. 08/728,816, filed on Oct. 10, 1996 and entitled "Universal, Height-Adjustable Hanger Bracket", the disclosure of which is fully incorporated herein by reference. As disclosed in that reference, each bracket includes a series of fastening tabs (not shown) that secure in two or more apertures 24 spaced along the upright posts 16.

Figure 2:
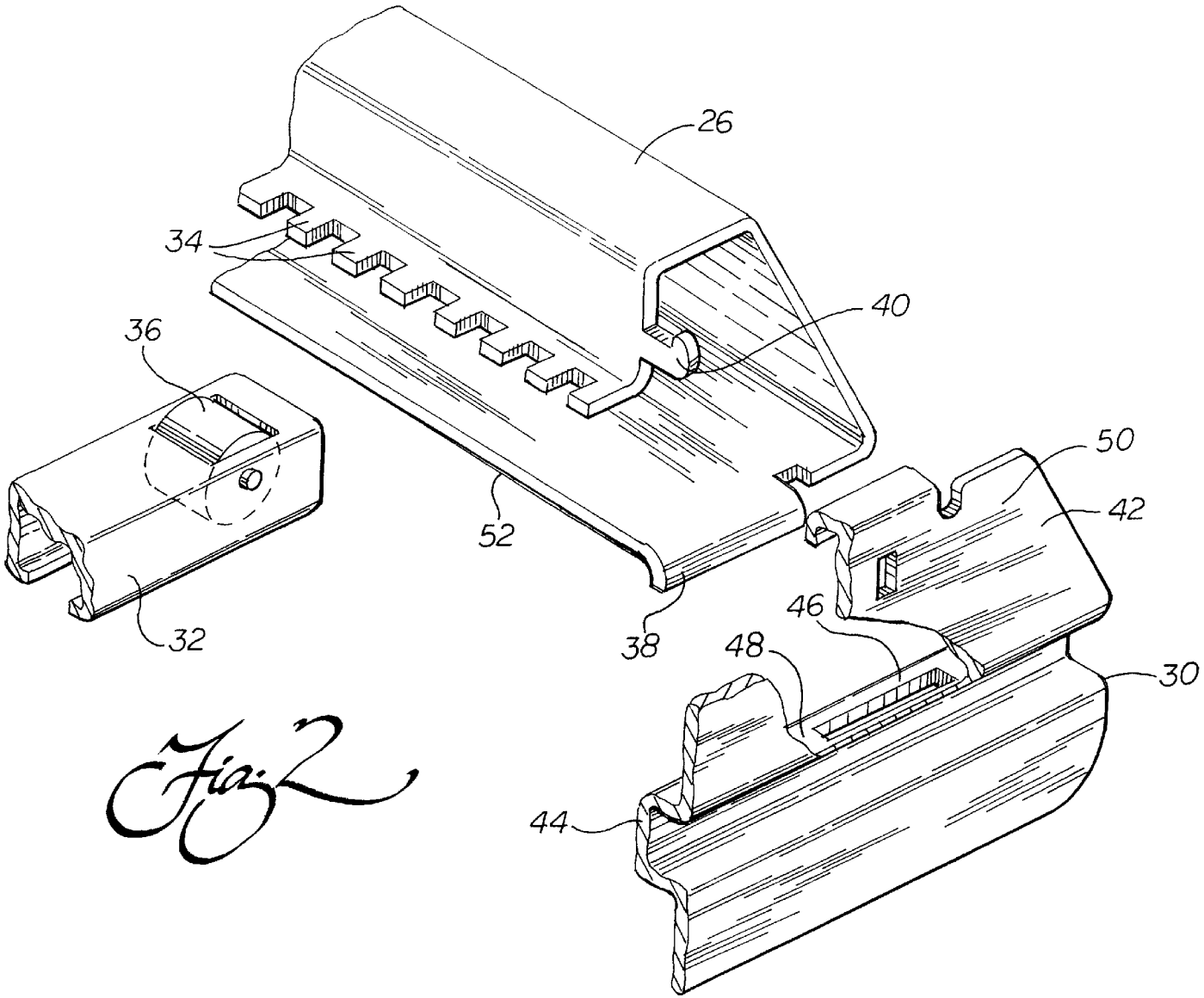
FIG. 2 is a broken away exploded perspective view of a shelf showing a first shelf rail, a second shelf rail and a roller track member.

As best shown with reference to FIGS. 1 and 2, each shelf 14 includes a front end rail 26 connected to a rear end rail 28 by means of a pair of opposed side rails 30. A series of track members 32 bridge between the front and rear end rails 26, 28 at spaced locations. As shown and described in greater detail in assignee's U.S. Pat. No. 4,394,910 to Miller, the full disclosure of which being incorporated herein by reference, each track member 32 is substantially U-shaped in section. The relative spacing between the track members 32 along the endrails 26, 28 may be adjusted by engaging the U-shaped track member over different teeth 34 carried by those end rails. Additionally, each track member 32 includes a series of spaced rollers 36 that rotate freely relative to the track member. Thus, when the shelves 12 are mounted to the frame 14 so as to be downwardly inclined toward the front end rail 26 as shown in FIG. 1, merchandise positioned on the shelves moves under the force of gravity over the rollers 36 towards the front rail. This allows individuals to easily select and reach the merchandise as desired.

In accordance with the teachings of the present invention, a first of the rails, the rear end rail 28, is connected to a second of the rails, the side rail 30, by means of a novel connection structure. As shown, the transverse end of the rail 28 includes a downwardly depending tongue 38 and an outwardly projecting tab in the form of a hook 40. As should be appreciated, the tongue 38 depends in a first plane and the hook 40 projects in a second plane substantially perpendicular to the first.

As further shown with reference to FIGS. 2, 3*a* and 3*b*, the rail 30 includes a sidewall 42 and a shelf supporting shoulder 44 which projects inwardly from the sidewall. A first longitudinal slot 46 is oriented in the upper wall 48 of the shoulder 44 and extends substantially horizontally in the first plane so as to correspond with the tongue 38. A second longitudinal slot 50 is provided in the sidewall 42 and extends substantially vertically in the second plane so as to substantially correspond with the hook 40. Accordingly, when the rails 28 and 30 are interconnected as shown in FIG. 3*b*, it should be appreciated that the upper wall 48 of the shoulder 44 engages the bottom wall 52 of the rail 28 thereby supporting its weight and further stabilizing and securing the connection.

The interconnection of the rails 28 and 30 may be completed in a relatively simple and straightforward manner. As shown in FIG. 3*a*, the siderail 30 is oriented so that the shoulder 44 projects inwardly and the upper wall 48 with the first slot 46 faces upwardly. Next, the rear end rail 28 is manipulated to engage the depending tongue 38 in the first slot 46 as shown. Once that tongue 38 is partially engaged, the rear end rail 28 is pivoted about the tongue in the direction of action arrow A as the tongue is fully inserted into the first slot so that the hook 40 engages in the second slot 50 as shown in FIG. 3*b*. In this fully connected position, the entire length of the outer margin of the bottom wall 52 of rail 28 rests upon the upper wall 48 of the shoulder 44. It should be appreciated that the substantially perpendicular orientation of the tongue 38 relative to the hook 40 in combination with the extended engagement between the shoulder 44 of the rail 30 and the bottom wall 52 of the rail 28 function to provide a very secure and stable connection between the rails 28, 30. A similar connection is provided at each end of the rear end rail 28 and front end rail 26 so that a substantially rectangular shelving framework is provided to hold the track members 32 of the gravity flow rack shelving system 10.

Figure 4:
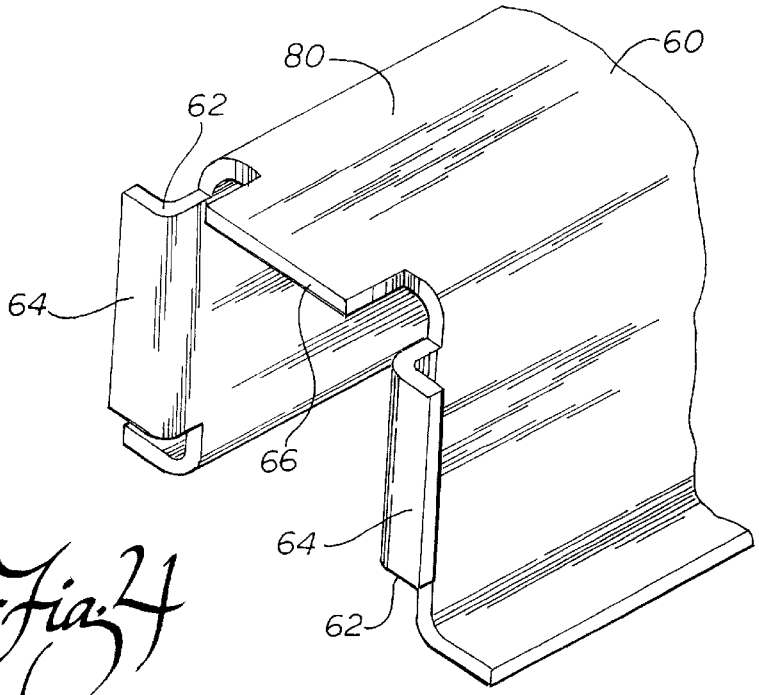
FIG. 4 is a detailed perspective view of an end of a crosstie showing the opposed, projecting L-shaped lugs.
Figure 6:
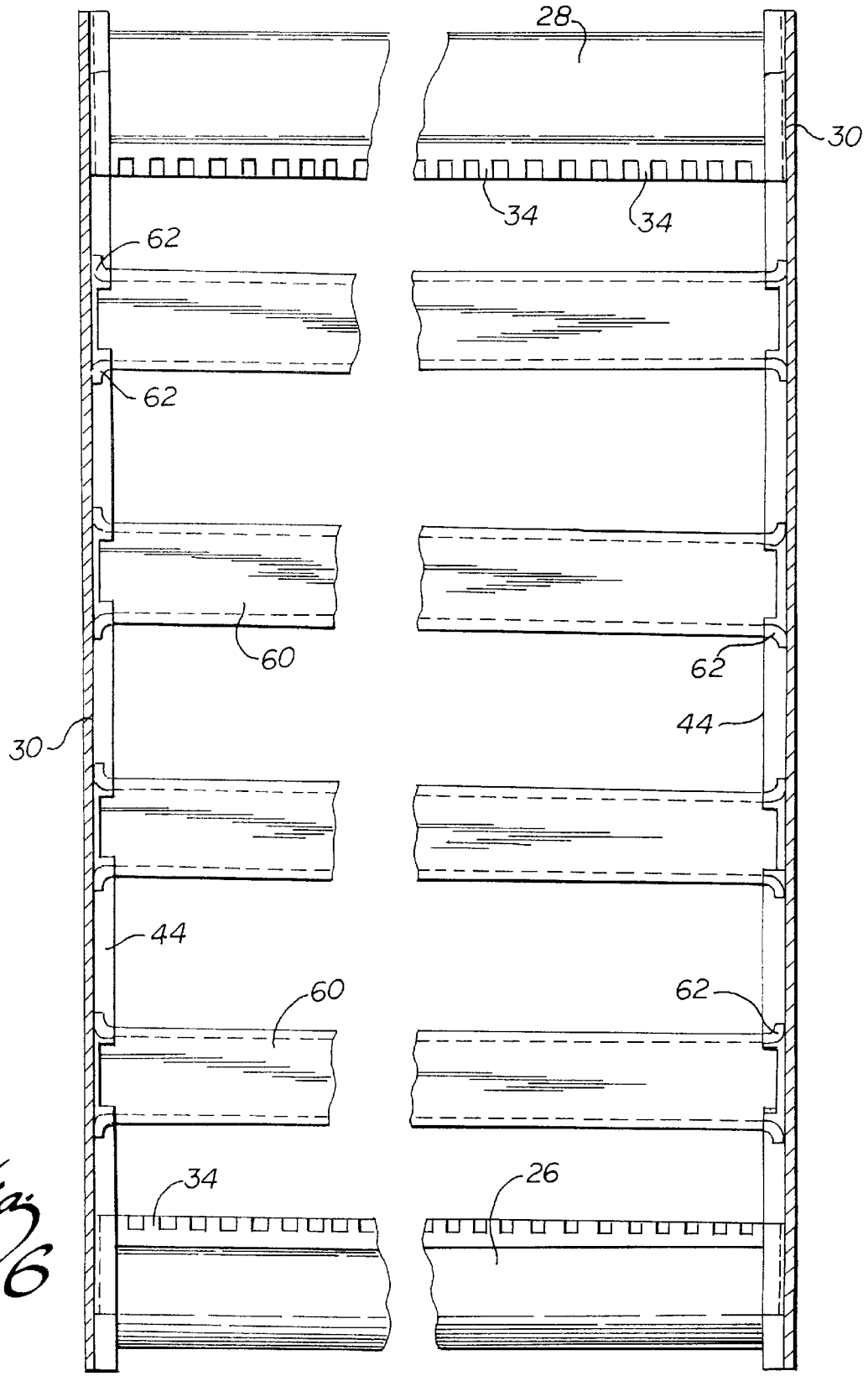
FIG. 6 is a top plan view illustrating a completed framework including first shelf rails, second shelf rails and crossties all interconnected without the use of any fasteners.

As further shown in FIG. 6, the substantially rectangular shelving framework formed by the front end rail 26, rear end rail 28 and siderails 30 may be further rigidified and secured by means of a series of crossties 60 which bridge between and interconnect the opposing siderails. More specifically, as shown in FIG. 4, each transverse end of the crosstie 60 includes a pair of projecting lugs 62 that are substantially L-shaped in plan view. As shown, the distal end or leg 64 of each of the pair of lugs 62 project in opposite directions. Further, each transverse end of the crosstie 60 includes a projecting support flange 66.

Figure 4A:
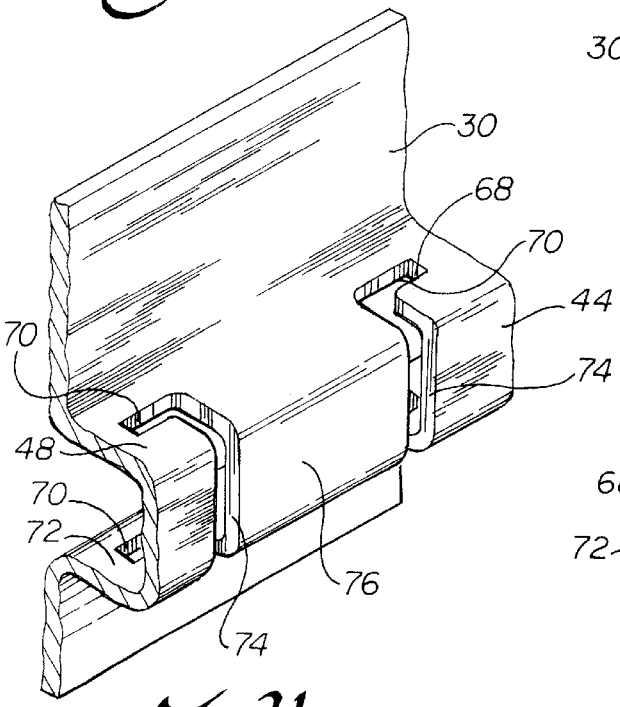
FIG. 4*a* is a detailed perspective view showing the registration slots in the shoulder of a second shelf rail that receive the lugs carried on the crosstie.
Figure 5:
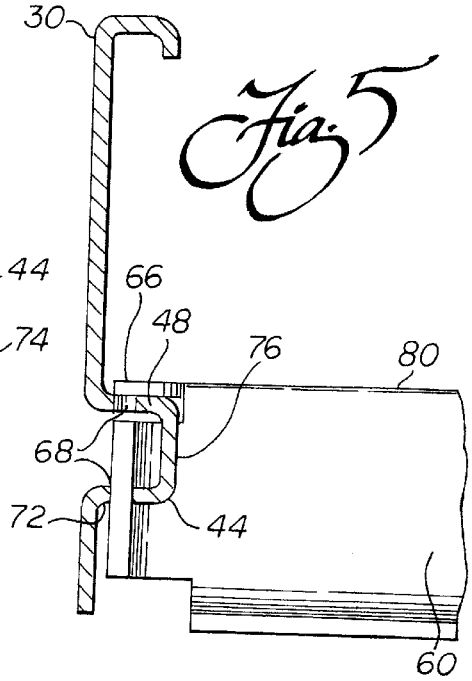
FIG. 5 shows the interconnection of the lugs of the crosstie of FIG. 4 with cooperating registration slots in the shoulder of a second shelf rail.

As shown in FIG. 4*a*, each of the shelf supporting shoulders 44 include a pair of cooperating registration slots 68. Each registration slot 68 includes a first portion 70 that extends in a first direction in the upper wall 48 and bottom wall 72 of the shoulder 44 and a second portion 74 that extends in a second orthogonal direction in the inner wall 76 of the shoulder.

With the front end rail 26, rear end rail 28 and siderails 30 interconnected as described above, a crosstie 60 may easily be interconnected between the opposing siderails 30. The crosstie 60 is manipulated so as to drop the lugs 62 at each end through the first portion 70 of the cooperating pair of registration slots 68 in the adjacent shoulder 44. The crosstie 60 drops downwardly into the slots 68 through the second portion 74 until the support flanges 66 engage the upper walls 48 of the shoulders 44.

When the crossties 60 are fully engaged with the siderails 30 in the manner described, it should be appreciated that the distal end or leg 64 of the lugs 62 are positioned in full engagement with the first portion 70 of the slots 68 in the bottom wall 72 of the shoulder 44. Thus, the crossties 60 effectively prevent any spreading or separating of the sidewalls 30 along the length thereof intermediate the end rails 26, 28. Accordingly, the crossties 60 serve to further secure the interconnection of the rectangular framework formed by the end rails 26, 28 and siderails 30. Additionally, it should be appreciated that the upper wall 80 of the crossties 60 function to support the track members 32 intermediate the ends thereof so that the entire system 10 is able to support greater weight of merchandise for user selection.

It should be appreciated that the method of interconnection places no stress or strain on the tongue 38 or hook 40 or the margins of the siderail 30 defining the slots 46, 50 during interconnection. Likewise, no stress or strain is placed upon the lugs 62 and support flanges 66 of the crossties 60 during interconnection. The lugs 62 simply drop right into the registration slots 68 under gravity without any application of pressure. There is no force fit to bend or otherwise damage the components yet a rigid and secure interconnection of parts is provided without the use of any separate fasteners. Further, it should be appreciated that the tongue 38 and hook 40 may be integrally formed with the rest of the rail 26, 28 out of the same relatively strong gauge material. The same is true of the lugs 62 and flange 66 of the crosstie 60. Thus, interconnection may be provided with little or no possibility of damaging the interconnection structure as often occurs in prior art fastenerless connection designs incorporating more lightweight, resilient materials. This is a significant benefit and is particularly important in installation where the gravity flow rack shelving system may periodically undergo disassembly and reconfiguration in order to meet a user's changing needs.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the end rail could include the shoulder and slots and the side rail could include the tongue and hook. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. In a shelving system including a shelf and a support frame, the improvement comprising:

a first shelf rail including a downwardly depending tongue and an outwardly projecting tab on an end thereof; and a second shelf rail including a side wall, a shelf supporting shoulder projecting from said side wall, a first slot in said shoulder for receiving said tongue and a second slot in said side wall for receiving said tab, said first slot and said tongue depending in a first plane and said second slot and said tab projecting in a second plane, said first and second planes being substantially perpendicular to one another.

2. The shelving system set forth in claim 1, wherein said first slot is oriented substantially horizontally and said second slot is oriented substantially vertically.

3. The shelving system set forth in claim 2, wherein said shoulder engages and supports a bottom wall of said first rail.

4. The shelving system set forth in claim 3, wherein said tab is a hook.

5. In a system including a shelf and support frame, the improvement comprising:

a pair of first shelf rails each including a downwardly depending tongue and an outwardly projecting tab;

a pair of second shelf rails each including a sidewall, a shelf supporting shoulder projecting from said sidewall, a first slot in said shoulder for receiving said tongue and a second slot in said sidewall for receiving said tab, said pair of first and pair of second shelf rails being interconnected together so as to form a rectangular framework; and wherein each of said shelf supporting shoulders includes a pair of registration slots and said system further includes a crosstie for interconnecting said pair of second shelf rails intermediate said pair of first shelf rails, said crosstie including a pair of projecting lugs at each end of said crosstie, for receipt in said pair of registration slots in said shelf supporting shoulder of each of said second shelf rail adjacent each of said crosstie ends.

6. The shelving system set forth in claim 5, wherein each of said pair of lugs is substantially L-shaped and a distal end of each of said pair of lugs projects in opposite directions.

7. The shelving system set forth in claim 6, wherein said crosstie further includes a projecting support flange at each end.

* * * * *